US005249437A

United States Patent [19]

Cole, Jr.

[11] Patent Number: 5,249,437

[45] Date of Patent: Oct. 5, 1993

[54] DEVICE FOR HOLDING PAPER CURRENCY, CREDIT CARDS AND THE LIKE

[76] Inventor: Walter W. Cole, Jr., 7151 Deerlake Ct., Clarkston, Mich. 48346

[21] Appl. No.: 923,851

[22] Filed: Jul. 31, 1992

[51] Int. Cl.[5] ..... A44C 25/00

[52] U.S. Cl. ..... 63/2; 24/498

[58] Field of Search ..... 63/2; 24/498, 518, 489, 24/499, 67 R

[56] References Cited

U.S. PATENT DOCUMENTS

| | | | |
|---|---|---|---|
| 534,044 | 2/1895 | Harding | 24/498 |
| 1,081,501 | 12/1913 | Hirsch | 24/518 |
| 1,500,907 | 7/1924 | Tucker | 24/498 |
| 1,566,976 | 12/1925 | Schmidt | 63/2 |
| 3,136,020 | 6/1964 | Baker | 24/498 |
| 3,452,457 | 7/1969 | Jones | 24/498 |
| 4,675,953 | 6/1987 | Higgs | 24/499 |
| 1,692,712 | 11/1928 | Tannebaum | 24/498 |

FOREIGN PATENT DOCUMENTS

| | | | |
|---|---|---|---|
| 457567 | 12/1936 | United Kingdom | 24/498 |

*Primary Examiner*—Peter M. Cuomo
*Assistant Examiner*—Flemming Saether
*Attorney, Agent, or Firm*—Daniel H. Bliss

[57] ABSTRACT

A device for holding articles includes a base member, a spring member extending outwardly and away from the base member, and a clamping member pivotally connected to the spring member for engaging and disengaging articles, the clamping member having an open position for disengaging articles and a closed position for engaging articles and holding the articles between the clamping member and the base member.

18 Claims, 2 Drawing Sheets

Fig-8
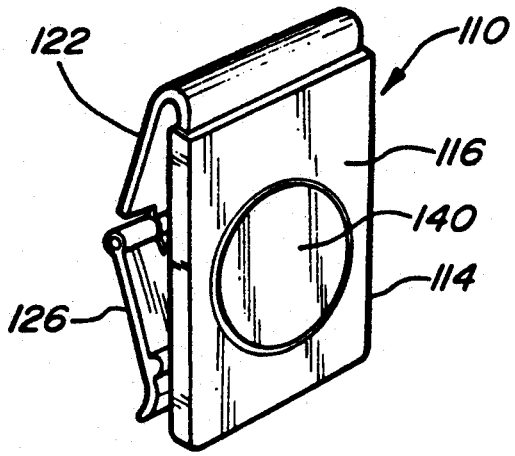
Fig-9
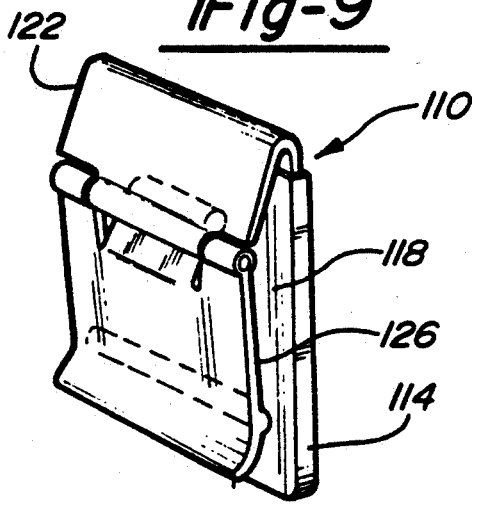
Fig-10
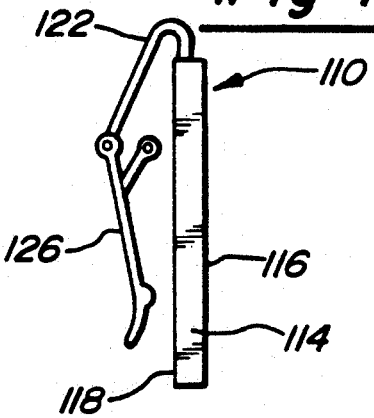
Fig-11
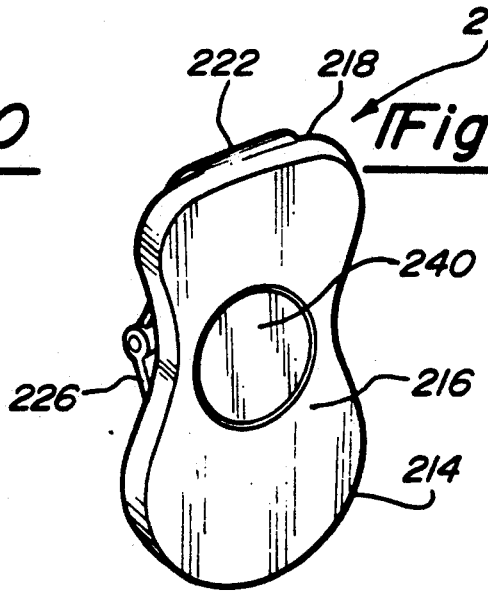
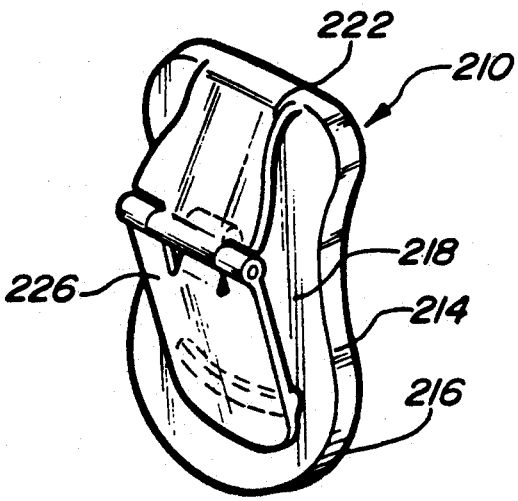
Fig-12
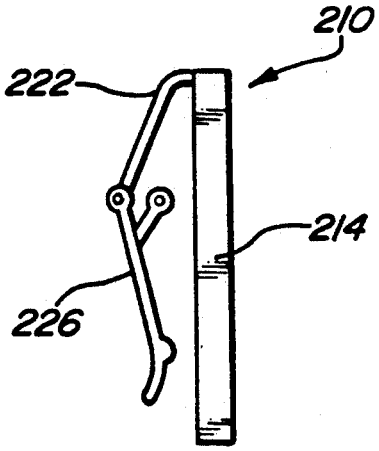
Fig-13

DEVICE FOR HOLDING PAPER CURRENCY, CREDIT CARDS AND THE LIKE

BACKGROUND OF THE INVENTION

1. Field of the Invention

The present invention relates generally to jewelry, and more particularly to a jewelry device for holding articles such as money and the like.

2. Description of Related Art

Money holders or money clips have been used for nearly as long as there has been paper currency. Many people prefer money clips over other conventional devices for storing currency such as wallets because the money clip does not increase substantially the amount of space required to store whatever amount of paper currency is being carried. This is particularly true of individuals who choose to carry their paper currency in pants pockets. Another preference perceived by some is that a money clip allows the paper currency to be displayed as it is being held in the money clip. This latter view nearly heightens the need for a decorative appearance for the money clip, and thus, the money clip or money holder is often considered a jewelry item.

Conventional money clips are relatively simple mechanical devices that are made from metal. The money clip typically has two arms, which when spread apart, provide a spring force tending to return the arms together. The most simple of money clips would be a bobby pin or a paper clip. However, due to the decorative or jewelry nature of the money clip, conventional money clips typically have a front or decorative face. This face can be decorated with jewels such as diamonds or a particular polished surface. The money clip would then hold the paper currency against the back of the decorative face.

While these conventional money clips have served their decorative or jewelry function, many of these clips do not achieve the primary function of holding the paper currency and cannot hold other objects such as credit cards. As a result, a person has the burden of carrying both a wallet and money clip to store their paper currency, credit cards, driver's license and the like. One drawback of conventional money clips is that the arms will eventually fail and lose their spring force to hold the paper currency. This failure is accelerated through the use of the clip to hold too large a thickness of paper currency. This loss of spring force is particularly critical in conventional money clips which concentrate the force at a relatively small area. Concentrating the force in such a small area makes it easier to insert and remove the paper currency from the money clip, but, as spring force is lost, makes it easier for the paper currency to be unintentionally dislodged from the money clip.

SUMMARY OF THE INVENTION

It is, therefore, one object of the present invention to provide a device for holding articles.

It is another object of the present invention to provide a device for holding articles such as paper currency, credit cards, driver's license and the like.

It is yet another object of the present invention to provide a device for holding articles which eliminates the need for both a wallet and money clip to store or hold the articles.

It is still another object of the present invention to provide a jewelry device having a decorative appearance for holding articles.

It is a further object of the present invention to provide a device for holding articles which retains its holding force.

To achieve the foregoing objects, the present invention is a device for holding articles including a base member and a spring member extending outwardly and away from the base member. The device also includes clamping means pivotally connected to the spring member for engaging and disengaging articles. The clamping means has an open position for disengaging articles and a closed position for engaging articles and holding the articles between the clamping means and the base member.

One advantage of the present invention is that a device is provided for holding articles. Another advantage of the present invention is that the device holds or stores paper currency, credit cards, driver's license and the like, thereby eliminating the need for both a wallet and money clip for the same. Another advantage of the present invention is that the device is jewelry item having a decorative appearance for holding articles. Yet another advantage of the present invention is that the device provides an over-center locking arrangement to retain its spring force against the articles being held.

Other objects, features and advantages of the present invention will be readily appreciated as the same becomes better understood after reading the following description taken in conjunction with the accompanying drawings.

BRIEF DESCRIPTION OF THE DRAWINGS

FIG. 8 is a front perspective view of a first alternate embodiment of the device of FIGS. 1 and 2.

FIG. 9 is a rear perspective view of the device of FIG. 8.

FIG. 10 is a left side view of the device of FIGS. 8 and 9.

FIG. 11 is a front perspective view of a second alternate embodiment of the device of FIGS. 1 and 2.

FIG. 12 is a rear perspective view of the device of FIG. 11.

FIG. 13 is a left side view of the device of FIGS. 11 and 12.

DESCRIPTION OF THE PREFERRED EMBODIMENT(S)

Figure 1:
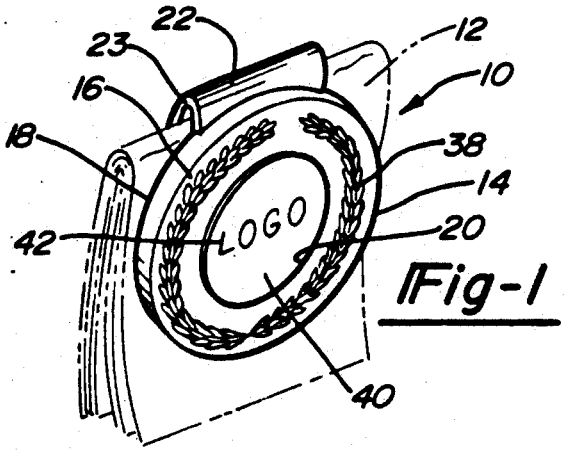
FIG. 1 is a front perspective view of a device for holding articles according to the present invention.
Figure 2:
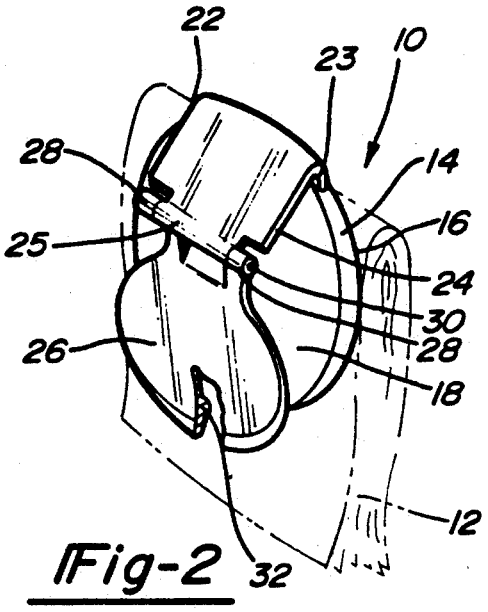
FIG. 2 is a rear perspective view of the device of FIG. 1 with a portion broken away.
Figure 3:
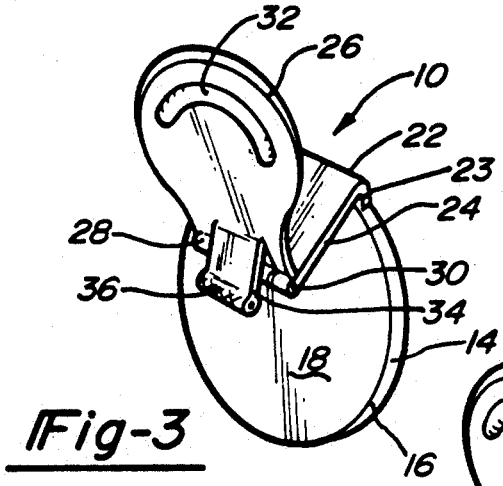
FIG. 3 is a view similar to FIG. 2 illustrating the device in an open position.
Figure 4:
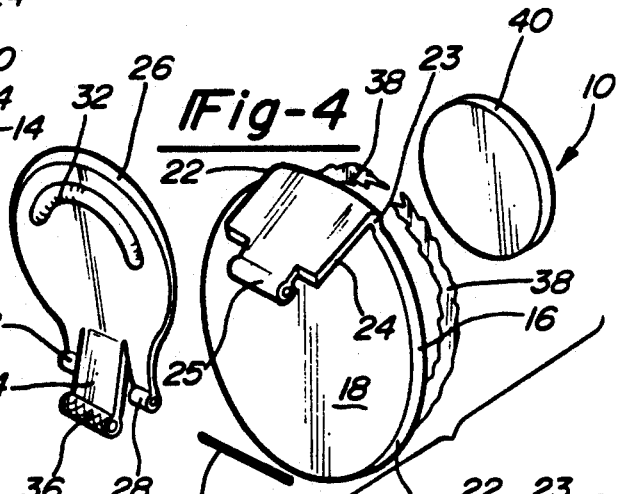
FIG. 4 is an exploded perspective view of the device of FIGS. 1 and 2.
Figure 5:
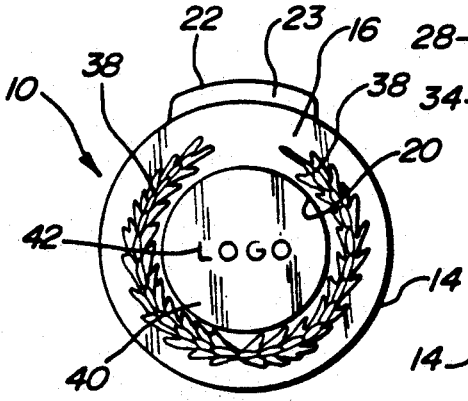
FIG. 5 is a front view of the device of FIGS. 1 and 2.

Referring to FIGS. 1 through 7, a device 10 is shown for holding articles 12 (phantom lines) such as paper currency, credit cards, driver's license and the like. The device 10 includes a base member 14 having a front surface 16 and a rear surface 18. Preferably, the base member 14 is generally circular in shape. The base member 14 has a cavity or pocket 20 which is generally circular in shape for a function to be described. It should be appreciated that the base member 14 may have any suitable shape.

The device 10 also includes a spring member 22 having resiliency or tension memory for providing a spring force. The spring member 22 has an arcuate portion 23 depending from the base member 14 which generally forms a U-shape. The spring member 22 also has a linear portion 24 extending from the arcuate portion 23 and outwardly and away from the base member 14. The spring member 22 includes a generally tubular member or sleeve 25 at one end of the linear portion 24. The spring member 22 may be integrally formed with the base member 14 or may be attached to the base member 14 through welding or other suitable means conventionally known.

The device 10 further includes a clamping member 26 for engaging and disengaging the articles 12. Preferably, the clamping member 26 is generally planar and circular in shape. The clamping member 26 is attached to the spring member 22 by a pivotal or hinge connection. The clamping member 26 includes a pair of laterally spaced sleeves 28 at one end to receive the sleeve 24 therebetween. A pin 30 is extended through the sleeves 24 and 28 to allow the spring member 22 and clamping member 26 to rotate relative to each other. It should be appreciated that the device 10 may have any suitable hinge mechanism to allow the spring member 22 and clamping member 26 to rotate relative to each other.

The clamping member 26 has a locking member 32 configured to concentrate a spring or holding force on the articles 12. Preferably, the locking member 32 is a solid raised portion which is generally circular in cross-section and arcuate in shape. It should be appreciated that the locking member 32 may be integrally formed with the clamping member 26 or may be attached to the clamping member 26 through welding or other suitable means conventionally known.

Figure 6:
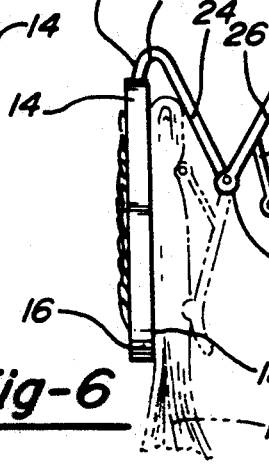
FIG. 6 is a right side view of the device of FIGS. 1 and 2 illustrated in an open and a closed position.
Figure 7:
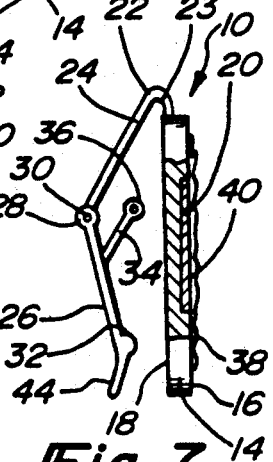
FIG. 7 is a left side view of the device of FIGS. 1 and 2 with a portion broken away.

The clamping member 26 also has a locking arm 34 extending outwardly above and axially past a pivot axis defined by the sleeves 28. The locking arm 34 has a locking member 36 at the distal end thereof to concentrate a spring or holding force on the articles 12. Preferably, the locking member 36 is a solid generally linear member having a circular cross-section. The locking members 32 and 36 include "CLIP GRIP TM". The CLIP GRIP TM is formed by saw cuts in an "X" or cross-cut shape therealong to provide a rough outer friction or gripping surface to grip the articles 12. When the clamping member 26 is pivoted into its locking or closed position as illustrated in FIG. 6, the locking arm 34 and member 36 produce an over-center locking arrangement. The locking members 32 and 36 each act such that the spring force from the spring member 22 is distributed between the two spaced apart members. It should be appreciated that the locking member 36 is spaced a predetermined minimum thickness from the base member 14 when the clamping member 26 is in a closed position.

While it is contemplated that the present invention could be made of many materials and produced in many processes, it is preferred that the device 10 be cast from a single material, preferably a metal such as gold, silver or an alloy thereof. The device 10 may also be made of a durable metal or plastic composite. The base member 14 and the spring member 22 may be cast as one piece, and the clamping member 26 may also be cast as a single piece.

The device 10 may include decorative material 38 on the base member 14. For example, the front surface 16 may be polished and act as a decorative face. Decorative material 38 such as garland is secured to the front surface 16 by suitable means such as welding or adhesive. Preferably, the decorative material 38 is cast as one piece from a single material as above-described. Also, the device 10 includes a "CLIP DISC TM". The CLIP DISC TM is a generally circular plate 40 having indicia 42 such as a logo. The circular plate 40 is permanently or removeably secured in the cavity 20 by suitable means. For example, the circular plate 40 may have magnetic properties to its material to be magnetically removable from the cavity 20. Alternatively, the circular plate 40 may be made of a single material as above-described and adhesively secured in the cavity 20 for permanent attachment. It should be appreciated that other decorative material such as decorative stones or diamonds be applied to the front surface 16.

Because the device 10 contemplates an over-center locking arrangement, the clamping member 26 may have a lip 44 which extends beyond the raised portion 3 to facilitate the unlocking motion. As illustrated in FIG. 6, the articles 12 are placed between the spring member 22 and the rear surface 18 of the base member 12. The clamping member 26 is rotated via the sleeves 24, 28 and pin 30 such that the locking member 36 engages and compresses the articles 12. A reaction force is generated causing the spring member 22 to deflect and produce a corresponding spring force. The spring force is distributed on the locking members 32 and 34. The lip 44 acts as a lever to overcome the over-center locking force to cause the clamping member 26 to rotate such that the locking members 32 and 36 disengage the articles 12. This over-center locking force is more secure than the simple spring force provided by standard money clips. It should be appreciated that the articles 12 have a predetermined minimum thickness to engage the locking member 36 and a predetermined maximum thickness to prevent permanent deflection or bending of the spring member 22.

Referring to FIGS. 8 through 10, a first alternate embodiment of the device 10 is shown. Like parts of the device 10 have like reference numerals increased by one hundred (100). Thus, the device 110 includes the base member 114 with a front surface 116 and a rear surface 118, spring member 122, and clamping member 126. Preferably, the base member 114 and clamping member 126 are generally rectangular in shape. As illustrated in FIG. 8, the base member 114 includes cavity 120 for the circular plate 40 which may have indicia (not shown) any other type of decorative material desired. The locking force is still generated in same way as the above described device 10, except that the locking member 132 is substantially linear, but the locking or spring force is still distributed along the locking members 132 and 134 which provides a more secure holding force.

Referring to FIGS. 11 through 13, a second alternate embodiment of the device 10 is shown. Like parts of the device 10 have like reference numerals increased by two hundred (200). Thus, the device 210 includes a base member 214 with a front surface 216 and a rear surface 218, a spring member 222 and clamping member 226. The base member 214 has a generally peanut shape and the clamping member 126 has a generally rectangular shape. The device 210 operates similar to device 10 and illustrates the number and variety of shapes available for the base member 214 to provide a pleasing appearance and still maintain the desired clamping force.

The present invention has been described in an illustrative manner. It is to be understood that the terminology which is to be used is intended to be in the nature of words of description rather than of limitation.

Many modifications and variations of the present invention are possible in light of the above teachings. Therefore, within the scope of the appended claims, the present invention may be practiced otherwise than is specifically described.

What is claimed is:

1. A device for holding articles such as paper currency and credit cards, comprising:

a base member;

a spring member extending outwardly and away from said base member;

clamping means pivotally connected to said spring member for engaging and disengaging the articles, said clamping means having an open position for disengaging the articles and a closed position for engaging the articles and holding the articles between said clamping means and said base member;

said clamping means comprising a clamping member having first and second ends, said first end pivotally connected to said spring member and said second end engaging the articles in said closed position; and a locking arm connected to said clamping member at a point between said first and second ends and extending inwardly at an angle beyond said first end toward said base member while in said closed position.

2. A device as set forth in claim 1 including hinge means for pivotally connecting said spring member and said clamping member together and for allowing rotation therebetween.

3. A device as set forth in claim 2 wherein said hinge means comprises a first tubular member on said spring member, a pair of laterally spaced second tubular members on said clamping member, said first tubular member being disposed between said second tubular members, and a pin extending through said first and second tubular members.

4. A device as set forth in claim 1 wherein said spring member includes an arcuate portion extending from one end of said base member and a linear portion extending from said arcuate portion, said first tubular member being disposed at a free end of said linear portion.

5. A device as set forth in claim 1 including a locking member attached to a free end of said locking arm.

6. A device as set forth in claim 5 wherein said locking member includes gripping means for producing a rough outer surface for gripping articles.

7. A device as set forth in claim 1 wherein said base member is generally circular in shape.

8. A device as set forth in claim 1 wherein said base member is generally rectangular in shape.

9. A device as set forth in claim 1 wherein said base member is generally peanut shaped.

10. A device as set forth in claim 1 including decorative means on at least one outer surface of said base member.

11. A device as set forth in claim 10 wherein said decorative means comprises garland secured to an outer surface of said base member.

12. A device as set forth in claim 10 wherein said decorative means comprises means forming a cavity in an outer surface of said base member and a plate secured in said cavity.

13. A device for holding articles such as paper currency and credit cards, comprising:

a base member;

a spring member extending outwardly and away from said base member;

clamping means pivotally connected to said spring member for engaging and disengaging the articles, said clamping means having an open position for disengaging the articles and a closed position for engaging the articles and holding the articles between said clamping means and said base member;

said clamping means comprising a clamping member having first and second ends, said first end being pivotally connected to said spring member and said second end engaging the articles in said closed position, a locking arm connected to said clamping member at a point between said first and second ends and extending inwardly at an angle beyond said first end toward said base member while in said closed position, and a locking member attached to a free end of said locking arm.

14. A device as set forth in claim 13 wherein said locking member includes gripping means for producing a rough outer surface for gripping articles.

15. A device as set forth in claim 14 including hinge means for pivotally connecting said spring member and said clamping member together and for allowing rotation therebetween.

16. A device as set forth in claim 15 wherein said hinge means comprises a first tubular member on said spring member, a pair of laterally spaced second tubular members on said clamping member, said first tubular member being disposed between said second tubular members, and a pin extending through said first and second tubular members.

17. A device as set forth in claim 16 wherein said spring member includes an arcuate portion extending from one end of said base member and a linear portion extending from said arcuate portion, said first tubular member being disposed at a free end of said linear portion.

18. A device for holding articles such as paper currency and credit cards, comprising:

a base member;

a spring member including an arcuate portion extending from one end of said base member, a linear portion extending from said arcuate portion, and a first tubular member being disposed at a free end of said linear portion;

clamping means pivotally connected to said spring member for engaging and disengaging the articles, said clamping means having an open position for disengaging the articles and a closed position for engaging the articles and holding the articles between said clamping means and said base member;

said clamping means comprising a clamping member having first and second ends, a pair of laterally spaced second tubular members on said first end, said first tubular member being disposed between said second tubular members, and a pin extending through said first and second tubular members for pivotally connecting said clamping member to said spring member and said second end engaging the articles in said closed position;

said clamping member including a locking arm connected to said clamping member at a point between said first and second ends and extending outwardly from said clamping member while in said close position at an angle beyond said first end, toward said base member; and a locking member attached to a free end of said locking arm for engaging and disengaging the articles.

* * * * *